US008320593B2

(12) United States Patent
Barthel et al.

(10) Patent No.: US 8,320,593 B2
(45) Date of Patent: Nov. 27, 2012

(54) METHOD AND HEARING APPARATUS FOR ADJUSTING A HEARING AID WITH DATA RECORDED IN AN EXTERNAL UNIT

(75) Inventors: Roland Barthel, Erlangen (DE); Ulrich Giese, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 351 days.

(21) Appl. No.: 12/753,981

(22) Filed: Apr. 5, 2010

(65) Prior Publication Data

US 2010/0254552 A1 Oct. 7, 2010

(30) Foreign Application Priority Data

Apr. 7, 2009 (DE) ..... 10 2009 016 656

(51) Int. Cl.
*H04R 5/02* (2006.01)

(52) U.S. Cl. ..... 381/314; 381/312

(58) Field of Classification Search ..... 381/314, 381/312

See application file for complete search history.

(56) References Cited

U.S. PATENT DOCUMENTS 4,972,487 A * 11/1990 Mangold et al. ..... 381/315
6,035,050 A * 3/2000 Weinfurtner et al. ..... 381/313
7,664,280 B2 * 2/2010 Rass ..... 381/315
7,826,631 B2 * 11/2010 Fischer et al. ..... 381/312
7,853,028 B2 * 12/2010 Fischer ..... 381/312
2007/0009126 A1 1/2007 Fischer

FOREIGN PATENT DOCUMENTS

DE 102008019898 A1 10/2009
EP 1845751 A1 10/2007

* cited by examiner

*Primary Examiner* — Forrest M Phillips

(74) *Attorney, Agent, or Firm* — Laurence A. Greenberg; Werner H. Stemer; Ralph E. Locher

(57) ABSTRACT

A hearing apparatus for adjusting a hearing aid and an associated method. The apparatus includes at least one hearing aid and at least one external unit which can exchange data with the hearing aid. It further includes a first memory unit in the external unit which stores a point in time and a hearing situation at which at least one predeterminable algorithm for signal processing is activated, an output unit in the external unit which outputs the stored points in time and hearing situations, an input unit in the external unit for entering a measure of evaluation which expresses the satisfaction of a hearing aid wearer with the activated algorithm, and a modification unit in the hearing aid for changing at least one parameter of the algorithm as a function of the measure of evaluation. The hearing aid user is able to evaluate and change the setting of their hearing aid retrospectively for specific hearing situations.

9 Claims, 3 Drawing Sheets

METHOD AND HEARING APPARATUS FOR ADJUSTING A HEARING AID WITH DATA RECORDED IN AN EXTERNAL UNIT

CROSS-REFERENCE TO RELATED APPLICATION

This application claims the priority, under 35 U.S.C. §119, of German patent application DE 10 2009 016 656.4, filed Apr. 7, 2009; the prior application is herewith incorporated by reference in its entirety.

BACKGROUND OF THE INVENTION

Field of The Invention

The invention relates to a method for adjusting a hearing aid with an external unit that is enabled to exchange data with the hearing aid. The invention also relates to a hearing apparatus for adjusting a hearing aid, comprising at least one hearing aid and at least one external unit.

The adjustment of hearing aids, especially in relation to amplification and compression, is nowadays frequently achieved by adaptation algorithms based on audiometric data. The level of hearing loss, the uncomfortable level, volume scaling and the like are typically regarded as audiometric data. The adaptation formulae are based on statistical and empirical knowledge and thus only apply to a limited extent to the individual hearing aid user. For optimum adjustment of the frequency and level-dependent gain in particular time consuming follow-up provision with the hearing aid audiologist is thus required. A further problem lies in the fact that the optimum setting of his hearing aid for the user can only be found and verified in realistic acoustic situations of relevance to the user.

Until now individual optimum settings have been found in repeated visits to the hearing aid audiologist. Since, however, specific acoustic situations are only able to be modeled unsatisfactorily at the hearing aid audiologist the setting found using such methods frequently turns out to be less suited to real situations. It is precisely the typical spatial sound field frequently available to the user or the individual requirements of the hearing aid user which cannot be emulated or taken into account in artificially created acoustic situations.

It is thus a desire when adjusting a hearing aid to be able to respond to individual conditions more explicitly.

Therefore modern digital hearing aids feature learning algorithms with the aid of which personal hearing aid settings can be learned. The hearing aid user optionally sets many different values for the hearing aid adjustments over a time-limited learning period or continuously over the lifetime of the hearing aid. But not all these adjustments have the same importance for the hearing aid user. A number of these adjustments will be quickly cancelled. Once the hearing aid user has found settings which correspond well to the hearing situation, he will leave these settings unchanged until such time as the hearing situation changes. For a learning algorithm all user adjustments are initially of equal importance. Therefore the satisfaction with a particular adjustment must be taken into account in some way.

There are two approaches to doing this: Time-based learning and event-based learning. With time-based learning hearing aid adjustments which will be used over a longer period are given more weight than settings with a shorter duration. A disadvantage of time-based learning is its limited applicability for signal-level-based learning. With a signal-level-based learning it is important for a learning step to take account of the current signal level. Thus there is also what is referred to as event-based learning. In such learning a learning step is carried out whenever the hearing aid user makes a change to his device, for example the amplification.

Event-based learning has its limitation however in that the importance of a training step is independent of the period of time for which an adjustment remains active. In other words, if the hearing aid user maintains a change over a long period, this change is not weighted any more heavily than a change made for a short period of time.

Our commonly assigned and later-published German patent application DE 10 2008 019 898 A1 specifies a method for overcoming the disadvantage described. There, there is described a method in which a desired adjustment value is entered into the hearing aid at a freely-selectable point in time, at least one sound value relating to an ambient situation at the freely-selectable point in time is measured, a duration is determined within which the desired adjustment value has not been changed and adjustment values to be used—depending on the desired adjustment value, of the at least one sound variable measured at the freely-selectable point in time and the period of time determined—are learnt.

The scope of the learning described is restricted however to algorithms which the hearing aid wearer can make via a control element such as for example a loudspeaker wire or a remote control "in vivo." Further algorithms which contribute in equal measure to the sound and wearing comfort are not learnt. For example a limitation of the maximum power output (MPO) cannot be learned with prior methods. The MPO only comes into effect as a rule for very loud, short, transient signals and is thus only able to be learned "in vivo" with great difficulty. Other examples are suppression methods for impulsive disturbance noises or feedback suppression. The situations in which the algorithm acts are too short to be able to react within the situation and to train the hearing aid.

Sometimes it is also not possible for a hearing aid user to adjust the hearing aid at the particular time. For example, when concentrating on a telephone call to the user cannot also be adjusting the hearing aid as well.

SUMMARY OF THE INVENTION

It is accordingly an object of the invention to provide a method and a device for adjusting a hearing aid which overcome the above-mentioned disadvantages of the heretofore-known devices and methods of this general type and which makes possible a temporal separation of event/hearing situation and hearing aid setting.

With the foregoing and other objects in view there is provided, in accordance with the invention, a method of adjusting a hearing aid with an external unit capable of exchanging data with the hearing aid, the method which comprises:

wearing the hearing aid by a hearing aid user;

storing points in time and hearing situations in the external unit for which at least one predeterminable algorithm for signal processing is activated in the hearing aid;

switching the hearing aid over into a learning mode;

outputting the stored points in time and hearing situations on the external unit;

prompting for an input of a measure of evaluation into the external unit, the measure of evaluation expressing a satisfaction of the hearing aid user with the activated algorithm; and changing at least one parameter of the respective algorithm in dependence on the measure of evaluation.

In other words, the above and other objects are achieved with a method for adjusting a hearing aid with an external unit that can exchange data with the hearing aid. The method comprises the following steps: wearing of the hearing aid by a hearing aid wearer, storage of times and hearing situations in the external unit at which at least one predetermined algorithm is activated in the hearing aid for signal processing, switching the hearing aid over into a learning mode, output of the stored times and hearing situations to the external unit, input of a measure of evaluation into the external unit expressing the satisfaction of the hearing aid wearer with the activated algorithm, and changing at least one parameter of the algorithm, depending on the measure of evaluation.

The invention offers the advantage of a hearing aid wearer being able to evaluate and change the adjustment of his hearing aid relative to hearing situation independently of hearing situations which occur. By making the setting afterwards when nobody is looking the hearing aid user can prevent anybody noticing that he or she is using a hearing aid. Short, prominent hearing situations, such as a banging door, the arrival of a train or a telephone ringing are too short for the hearing aid user to have the opportunity to make an adjustment to their hearing aid. The invention guarantees that an adjustment can be made at a later time.

In a development of the invention the hearing situation can be identified and described by a situation recognition and/or at least one signal level measurement and/or at least one algorithm.

In a further embodiment the inventive method comprises the following steps: storage of clips of microphone signals of the hearing aid and output of the clips by the hearing aid. The advantage of this is that the hearing aid user is certain of recognizing the particular hearing situation.

With the above and other objects in view there is also provided, in accordance with the invention, a hearing apparatus (for adjusting a hearing aid with an external unit), comprising:

at least one hearing aid to be worn by a hearing aid user;

at least one external unit configured to exchange data with the hearing aid, the external unit including:

a memory unit configured to store points in time and hearing situations in which at least one predetermined algorithm for signal processing is activated;

an output unit configured to output the stored points in time and hearing situations; and an input unit for enabling entry of a measure of evaluation expressing a satisfaction of the hearing aid user with a respectively activated algorithm; and the hearing aid including a modification unit configured to change at least one parameter of the algorithm in dependence on the measure of evaluation.

In other words, the hearing apparatus for adjusting a hearing aid comprises at least one hearing aid and at least one external unit which can exchange data with the hearing aid. The hearing apparatus comprises: a first memory unit in the external unit which stores the points in time and the hearing situations at which at least one predeterminable algorithm for signal processing is activated, an output unit in the external unit which outputs the stored points in time and hearing situations, an input unit in the external unit for entering a measure of evaluation which expresses the satisfaction of a hearing aid wearer with the algorithm activated, and a modification unit in the hearing aid for changing at least one parameter of the algorithm as a function of the measure of evaluation.

In a development the hearing apparatus can include a situation recognition unit and/or at least one signal level meter in the hearing aid which recognize and define the hearing situation.

In a further embodiment the external unit can be a remote control. This provides a simple option for adjustment.

Furthermore the output unit can include a display unit. This makes an optical display possible.

In addition the hearing apparatus can include a second memory unit in the hearing aid which stores clips of microphone signals of the hearing aid.

Advantageously the stored clips of microphone signals of the hearing aid can be output by the hearing aid.

Other features which are considered as characteristic for the invention are set forth in the appended claims.

Although the invention is illustrated and described herein as embodied in a method and hearing apparatus for adjusting a hearing aid with data recorded in an external unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
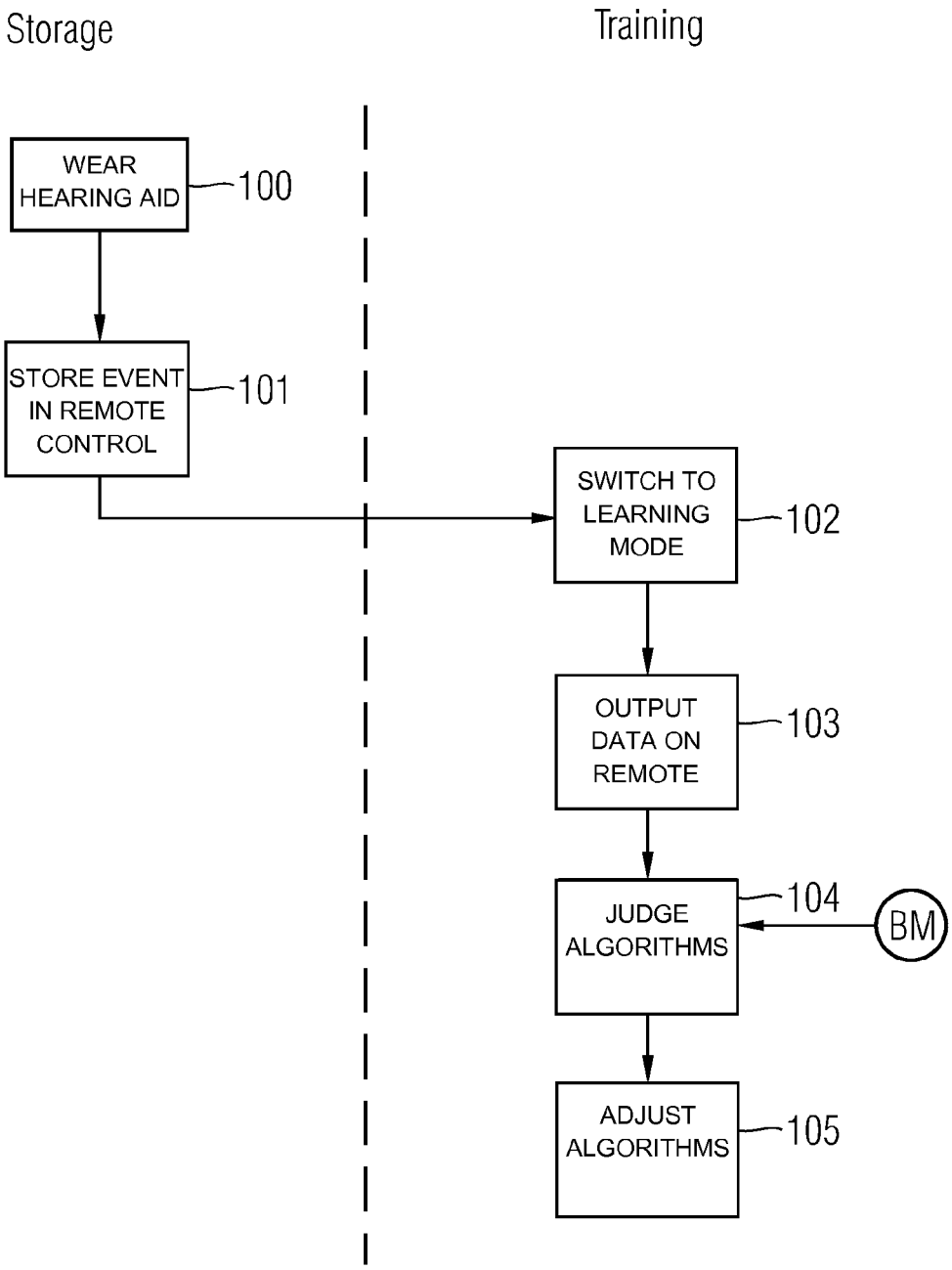
FIG. 1 a flow diagram illustrating the method according to the invention.

Referring now to the figures of the drawing in detail and first, particularly, to FIG. 1 thereof, there is shown a flowchart of an inventive method for adjusting a hearing aid with an external unit, for example with a remote control that can exchange data with a hearing aid. In a first step 100 the wearer wears the hearing aid for which the parameters are to be adjusted. The remote control stores in step 101 those points in time and hearing situations in which at least one predetermined algorithm of a hearing aid signal processing will be activated.

In the subsequent step 102 the hearing aid is switched over to a learning mode. This can be done by the hearing aid wearer in the evening for example. Preferably the switchover is made using the remote control. Subsequently in step 103 the recorded data is output or displayed at the remote control device, here "remote" for short. For the output or display of the data relating to the acoustic situation results such as those from a hearing aid's own situation recognition unit but also different signal level meters can be used in order to be able to characterize the acoustic situation more representatively based on this data. The output can also include a short text description of the hearing situation such as "telephone" or "conversation" for example. Recorded clips of the microphone signal can also be played by the hearing aid. These serve to better remind the hearing aid wearer of the hearing situation. In the subsequent step 104 the hearing aid wearer assesses their satisfaction with the setting of the algorithm for the specific hearing situation. To do this a measure of evaluation BM is entered into the remote control. To this end the remote control offers the hearing aid wearer various choice options for the evaluation BM. The simplest evaluation BM comprises three classifications: "too loud," "ok" and "too quiet."

In the final step 105 one or more parameters of the selected and displayed algorithm are changed in accordance with the measure of evaluation BM. If the evaluation is "ok" no change is made.

If, for example, a hearing aid wearer is concentrating during a telephone conversation on the speech and on their understanding of it, they cannot direct their attention to adjusting a hearing aid at the same time. The remote control notes the time of the telephone conversation and the hearing aid if necessary records an extract from the telephone conversation. Later the hearing aid wearer can call up the stored hearing situation by "scrolling" in the remote control and operating the normal control elements such as volume or tone.

Figure 2:
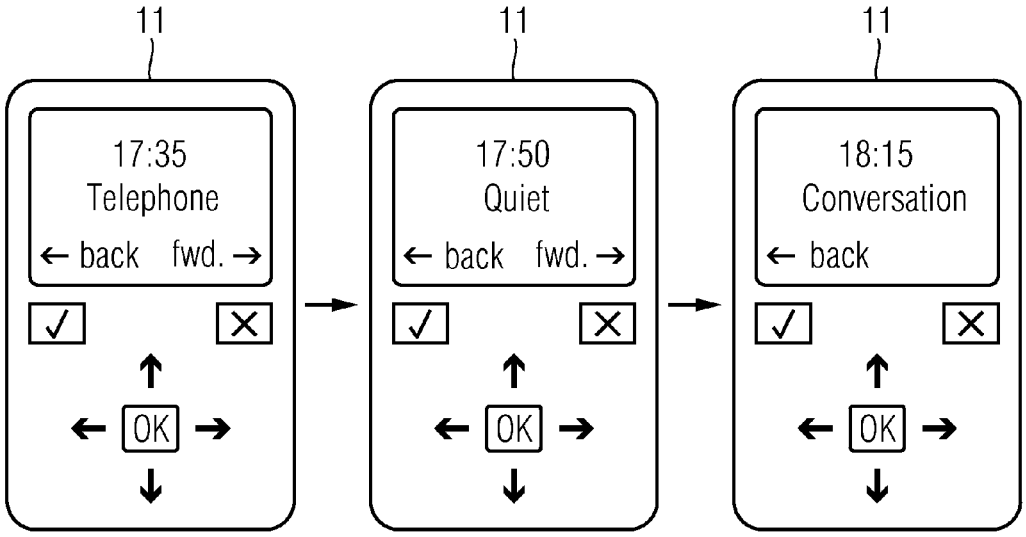
FIG. 2 illustrates three exemplary displays of a remote control.

FIG. 2 shows an example of three different displays on a remote control 11 which are offered to a hearing aid user for adjusting his hearing aid with the aid of recorded hearing situations.

Figure 3:
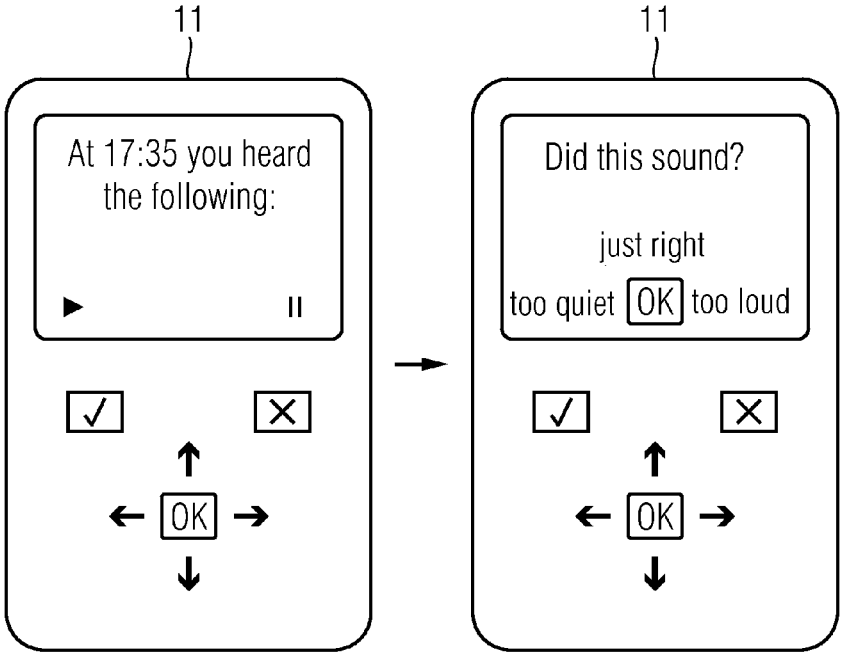
FIG. 3 illustrates two further exemplary displays of a remote control.

FIG. 3 shows two different displays for the hearing situation "telephone" from FIG. 2. The hearing aid user can listen to a part of the telephone conversation clip in order to better remember the hearing situation and undertake assessments with the classifications "too quiet," "ok," or "too loud."

Figure 4:
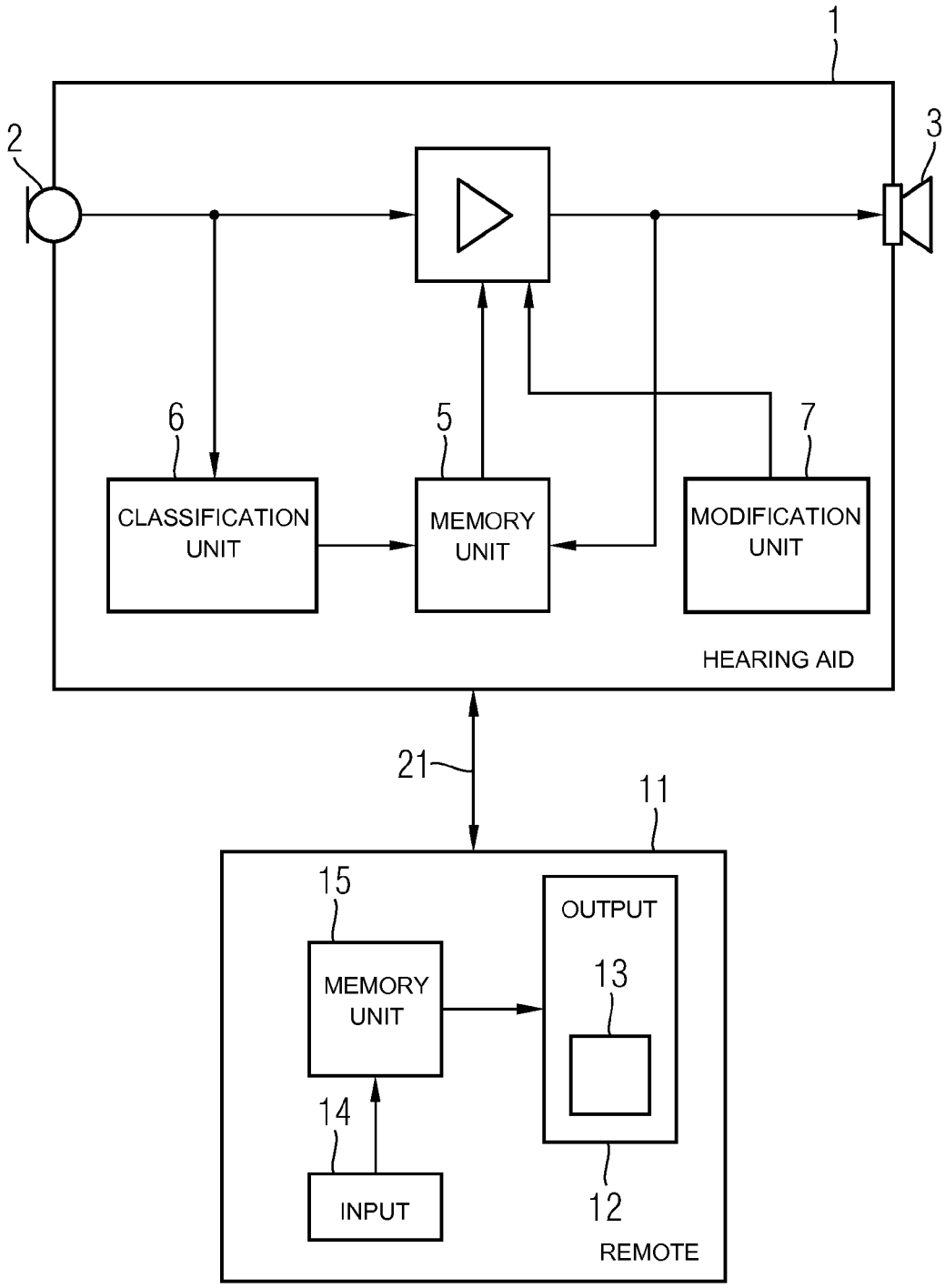
FIG. 4 is a block diagram of a hearing apparatus according to the invention.

FIG. 4 shows a block diagram of a hearing apparatus according to the invention, with a hearing aid 1 and a remote control device 11. The hearing aid 1 includes a microphone 2 for recording ambient sound and converting it into an electrical signal, a signal processing unit 4 connected to the microphone 2, which digitizes the electrical signal, modifies it, amplifies it and converts it back into an analog signal, which is finally output via an earpiece 3 as an amplified and modified acoustic signal to the eardrum of a hearing aid wearer.

To execute the inventive method the hearing aid 1 further possesses a classification unit 6 connected to the output of the microphone 2 which classifies each hearing situation. In a second memory unit 5, which is connected to the signal processing unit 4, clips of earpiece signals can be recorded. The remote control 11 possesses a first memory unit 15 which stores algorithms selected by the signal processing unit 4 as well as the associated hearing situations and timestamps. With the aid of a modification unit 7 in the hearing aid 1, the parameters of the algorithms of the signal processing unit 4 can be changed if necessary.

The hearing aid 1 can be switched into a training mode with the remote control 11 in which the stored hearing situations with the associated algorithms can be called up from the first memory unit 15 of the remote control 11 and can be presented on an output unit 12, which comprises a display unit 13. With the output unit 12 the hearing aid user can be reminded again of the hearing situation with the associated algorithms. The hearing aid user can thus evaluate the hearing situation and the associated reaction of the hearing aid 1 and communicate this evaluation via and input unit 14 of the remote control in 11 to the hearing aid 1. In accordance with the evaluation, the modification unit 7 changes one or more parameters of the algorithm appropriate to the respective hearing situation. With the aid of the remote control 11 and the interactive dialog implemented within it the hearing aid wearer can thus train the hearing aid 1 in the evenings for example. The communication between the hearing aid 1 and the remote control 11 is undertaken using wireless data transmission 21.

The invention claimed is:

1. A method of adjusting a hearing aid with an external unit capable of exchanging data with the hearing aid, the method which comprises:

wearing the hearing aid by a hearing aid user and processing audio signals in a processing unit of the hearing aid in accordance with a respectively activated algorithm for signal processing;

storing points in time and hearing situations in the external unit for the algorithm for signal processing is activated in the hearing aid and also storing separately the activated algorithm;

switching the hearing aid over into a learning mode;

outputting the stored points in time and hearing situations on the external unit;

prompting for an input of a measure of evaluation into the external unit, the measure of evaluation expressing a satisfaction of the hearing aid user with the activated algorithm; and changing at least one parameter of the respective algorithm in dependence on the measure of evaluation.

2. The method according to claim 1, wherein the hearing situation is identified and described by at least one of a situation recognition, at least one signal level measurement, and at least one algorithm.

3. The method according to claim 1, which comprises storing clips of a microphone signal of the hearing aid and outputting the clips by the hearing aid.

4. A hearing apparatus, comprising: at least one hearing aid to be worn by a hearing aid user;

at least one external unit configured to exchange data with said hearing aid, said external unit including:

a memory unit configured to store a given algorithm for signal processing activate in the hearing aid, and separately points in time and hearing situations in the algorithm for signal processing is activated;

an output unit configured to output the stored points in time and hearing situations; and an input unit for enabling entry of a measure of evaluation expressing a satisfaction of the hearing aid user with a respectively activated algorithm; and said hearing aid including a modification unit configured to change at least one parameter of the algorithm in dependence on the measure of evaluation.

5. The hearing apparatus according to claim 4, wherein said hearing aid includes at least one of a situation recognition unit and at least one signal level meter configured to recognize and define the hearing situation.

6. The hearing apparatus according to claim 4, wherein said external unit is a remote control device.

7. The hearing apparatus according to claim 4, wherein said output unit comprises a display unit.

8. The hearing apparatus according to claim 4, wherein said hearing aid includes a memory unit for storing clips of microphone signals of said hearing aid.

9. The hearing apparatus according to claim 8, wherein the stored clips of the microphone signals are output by the hearing aid.

* * * * *

UNITED STATES PATENT AND TRADEMARK OFFICE

CERTIFICATE OF CORRECTION

PATENT NO. : 8,320,593 B2
APPLICATION NO. : 12/753981
DATED : November 27, 2012
INVENTOR(S) : Roland Barthel et al.

It is certified that error appears in the above-identified patent and that said Letters Patent is hereby corrected as shown below:

Column 6,

Lines 37 - 38, "separately points in time and hearing situations in the algorithm" should read -- separately points in time and hearing situations in which the algorithm --

Signed and Sealed this
Nineteenth Day of March, 2013

Teresa Stanek Rea
*Acting Director of the United States Patent and Trademark Office*